US010150586B2

(12) United States Patent
Carden et al.

(10) Patent No.: US 10,150,586 B2
(45) Date of Patent: Dec. 11, 2018

(54) BOX ASSEMBLIES AND MULTI-PLY UNITS AND METHODS FOR FORMING SAME

(71) Applicants: 1540 Innovatus, LLC, Franklinton, NC (US); Quinstar, Inc., Clayton, NC (US)

(72) Inventors: Kevin B. Carden, Franklinton, NC (US); James F. Royall, Clayton, NC (US); Steven Lee Worm, Raleigh, NC (US)

(73) Assignees: 1540 Innovatus, LLC, Raleigh, NC (US); Quinstar, Inc., Clayton, NC (US)

( * ) Notice: Subject to any disclaimer, the term of this patent is extended or adjusted under 35 U.S.C. 154(b) by 0 days.

(21) Appl. No.: 15/162,187

(22) Filed: May 23, 2016

(65) Prior Publication Data

US 2017/0129639 A1 May 11, 2017

Related U.S. Application Data

(60) Provisional application No. 62/251,806, filed on Nov. 6, 2015.

(51) Int. Cl.
*B65D 5/24* (2006.01)
*B65D 5/22* (2006.01)
(Continued)

(52) U.S. Cl.
CPC ..... *B65D 5/248* (2013.01); *B65D 5/22* (2013.01); *B65D 5/241* (2013.01); *B65D 5/30* (2013.01);
(Continued)

(58) Field of Classification Search
CPC . B65D 5/22; B65D 5/241; B65D 5/30; B65D 5/62; B65D 5/68; B65D 65/403;
(Continued)

(56) References Cited

U.S. PATENT DOCUMENTS 1,758,511 A * 5/1930 Gross ..... B65D 5/2095 229/117.03
2,334,425 A 11/1943 Lowey
(Continued)

FOREIGN PATENT DOCUMENTS

WO WO 2013/055868 A1 4/2013
WO WO 2013/098544 A1 7/2013

OTHER PUBLICATIONS

Notification of Transmittal of the International Search Report and the Written Opinion of the International Searching Authority, or the Declaration, in corresponding PCT Application No. PCT/US2016/060024 dated Feb. 27, 2017 (8 pages).

*Primary Examiner* — Christopher Demeree
(74) *Attorney, Agent, or Firm* — Myers Bigel, P.A.

(57) ABSTRACT

A blank for forming a carton includes a unitary substrate layer defining a primary axis and a secondary axis transverse to the primary axis. The substrate layer includes: a main panel having a side edge extending substantially parallel to the primary axis and an end edge substantially parallel to the secondary axis; an end outer panel connected to the end edge by a first fold line extending substantially parallel to the secondary axis; an end inner panel connected to the end outer panel by a second fold line extending substantially parallel to the secondary axis; a side outer panel connected to the side edge by a third fold line extending substantially parallel to the primary axis; a side inner panel connected to the side outer panel by a fourth fold line extending substantially parallel to the primary axis; a notch defined in a side edge of the end inner panel; and an integral tab extending from an end edge of the side inner panel adjacent the side edge of the end inner panel. The blank is configured to be erected into a carton by: folding the end outer panel relative to the main panel about the first fold line; folding the end inner panel relative to the end outer panel about the second
(Continued)

fold line so that the end inner panel substantially faces the end outer panel and is deflectably spaced away from the end outer panel; folding the side outer panel relative to the main panel about the third fold line so that the side inner panel substantially faces the side outer panel, whereby a pocket is defined between the notch, the side outer panel, and the end outer panel; folding the side inner panel relative to the side outer panel about the fourth fold line so that the side inner panel substantially faces the side outer panel; and inserting the tab into the pocket to interlock the side inner panel and the end inner panel.

27 Claims, 9 Drawing Sheets

(51) Int. Cl.

| | |
|---|---|
| ***B65D 5/30*** | (2006.01) |
| ***B31B 3/60*** | (2006.01) |
| ***B31B 3/26*** | (2006.01) |
| ***B65D 5/68*** | (2006.01) |
| ***B65D 65/40*** | (2006.01) |
| ***B65D 5/62*** | (2006.01) |

(52) U.S. Cl.
CPC ..... *B65D 5/62* (2013.01); *B65D 5/68* (2013.01); *B65D 65/403* (2013.01)

(58) Field of Classification Search
CPC .... B65D 5/248; B65D 5/3664; B65D 5/0035; B65D 5/2095; B31B 3/26; B31B 3/60; B31B 50/8121
USPC ..... 229/164.1, 176, 172, 186, 125.19, 174, 229/165, 168, 169, 187, 188, 122.32, 229/122.33, 122.34; 493/140, 168; 206/45.21, 509, 557
See application file for complete search history.

(56) References Cited

U.S. PATENT DOCUMENTS

| | | | | |
|---|---|---|---|---|
| 2,769,588 | A | 11/1956 | Beck | |
| 4,253,602 | A * | 3/1981 | Kulig | B65D 5/2047 229/171 |
| 5,044,547 | A * | 9/1991 | Hartman | B65D 5/248 229/175 |
| 5,632,713 | A | 5/1997 | Canning et al. | |
| 5,845,841 | A | 12/1998 | Canning | |
| 5,992,732 | A | 11/1999 | Canning | |
| 7,882,999 | B2 * | 2/2011 | Canning | B65D 5/248 229/116.5 |

* cited by examiner

BOX ASSEMBLIES AND MULTI-PLY UNITS AND METHODS FOR FORMING SAME

RELATED APPLICATION(S)

The present application claims the benefit of and priority from U.S. Provisional Patent Application No. 62/251,806, filed Nov. 6, 2015, the disclosure of which is incorporated herein by reference in its entirety.

FIELD OF THE INVENTION

The present invention relates to boxes and, more particularly, to erectable boxes and preformed units for forming the same.

BACKGROUND OF THE INVENTION

It is known to provide multi-ply boxes including a rigid or semi-rigid substrate structure (e.g., formed of folded paperboard) and an overlying decorative outer layer (e.g., paper). The outer layer may be bonded to the substrate only at selected locations to give the appearance that the outer layer is loosely wrapped about the substrate in the manner of traditional wrapping paper. Such boxes may be formed or erected from blanks that are folded and secured in an erected from blanks that are folded and secured in an erected configuration. An example of such a box is disclosed in U.S. Pat. No. 7,882,999 to Canning.

SUMMARY OF THE INVENTION

According to embodiments of the invention, a blank for forming a carton includes a unitary substrate layer defining a primary axis and a secondary axis transverse to the primary axis. The substrate layer includes: a main panel having a side edge extending substantially parallel to the primary axis and an end edge substantially parallel to the secondary axis; an end outer panel connected to the end edge by a first fold line extending substantially parallel to the secondary axis; an end inner panel connected to the end outer panel by a second fold line extending substantially parallel to the secondary axis; a side outer panel connected to the side edge by a third fold line extending substantially parallel to the primary axis; a side inner panel connected to the side outer panel by a fourth fold line extending substantially parallel to the primary axis; a notch defined in a side edge of the end inner panel; and an integral tab extending from an end edge of the side inner panel adjacent the side edge of the end inner panel. The blank is configured to be erected into a carton by: folding the end outer panel relative to the main panel about the first fold line; folding the end inner panel relative to the end outer panel about the second fold line so that the end inner panel substantially faces the end outer panel and is deflectably spaced away from the end outer panel; folding the side outer panel relative to the main panel about the third fold line so that the side inner panel substantially faces the side outer panel, whereby a pocket is defined between the notch, the side outer panel, and the end outer panel; folding the side inner panel relative to the side outer panel about the fourth fold line so that the side inner panel substantially faces the side outer panel; and inserting the tab into the pocket to interlock the side inner panel and the end inner panel.

In some embodiments, the blank is configured to elastically deflect the end inner panel toward the end outer panel to permit the tab to pass over the end inner panel as the side inner panel is folded toward the side outer panel, and to release the end inner panel to spring away from the end outer panel after the tab has entered the notch. According to some embodiments, the blank provides tactile and/or audible feedback when the end inner panel springs away from the end outer panel after the tab has entered the notch.

In some embodiments, the blank is configured to release the tab from the pocket when the carton is erected and the end inner panel is deflected toward the end outer panel.

According to some embodiments, when the carton is erected, the end inner panel and the side inner panel each exert a spring force on the other.

In some embodiments, the blank further includes an end foot panel connected to the end inner panel along a fifth fold line, the blank further includes a side foot panel connected to the side inner panel along a sixth fold line, and when the carton is erected, the side foot panel overlaps the end foot panel to capture the end foot panel between the side foot panel and the main panel and thereby inhibit the end inner panel from pivoting away from the end outer panel.

The blank may further include an outer decorative sheet bonded to an outer surface of the substrate layer and covering at least a portion of each of the main panel, the end outer panel and the side outer panel. In some embodiments, the outer decorative sheet is loose wrap bonded to the substrate layer. In some embodiments, the outer decorative sheet includes a corner section extending beyond the end outer panel and the side outer panel, and the corner section has a cross edge defining an oblique angle with each of the primary axis and the secondary axis.

According to some embodiments, at least some of the first, second, third, and fourth fold lines are of a first type and at least some of the first, second, third, and fourth fold lines are of a second type, wherein the fold lines of the first type exert a greater return spring force when folded than do the fold lines of the second type when folded. In some embodiments, the fold lines of the first type are creases in the substrate layer and the fold lines of the second type are lines of perforations in the substrate layer.

In some embodiments, the substrate layer includes a first corner panel connected to the end outer panel by a first corner fold line, and a second corner panel connected to the side outer panel by a second corner fold line and to the first corner panel by a third corner fold line. The first corner panel is adhered to the end outer panel or the second corner panel is adhered to the side outer panel.

According to method embodiments of the invention, a method for forming a carton includes providing a blank including a unitary substrate layer, the blank defining a primary axis and a secondary axis transverse to the primary axis. The substrate layer includes: a main panel having a side edge extending substantially parallel to the primary axis and an end edge substantially parallel to the secondary axis; an end outer panel connected to the end edge by a first fold line extending substantially parallel to the secondary axis; an end inner panel connected to the end outer panel by a second fold line extending substantially parallel to the secondary axis; a side outer panel connected to the side edge by a third fold line extending substantially parallel to the primary axis; a side inner panel connected to the side outer panel by a fourth fold line extending substantially parallel to the primary axis; a notch defined in a side edge of the end inner panel; and an integral tab extending from an end edge of the side inner panel adjacent the side edge of the end inner panel. The method further includes: folding the end outer panel relative to the main panel about the first fold line; folding the end inner panel relative to the end outer panel about the second fold line so that the end inner panel substantially faces the end outer panel and is deflectably spaced away from the end outer panel; folding the side outer panel relative to the main panel about the third fold line so that the side inner panel substantially faces the side outer panel, whereby a pocket is defined between the notch, the side outer panel, and the end outer panel; folding the side inner panel relative to the side outer panel about the fourth fold line so that the side inner panel substantially faces the side outer panel; and inserting the tab into the pocket to interlock the side inner panel and the end inner panel.

The method may include: elastically deflecting the end inner panel toward the end outer panel to permit the tab to pass over the end inner panel as the side inner panel is folded toward the side outer panel; and releasing the end inner panel to spring away from the end outer panel after the tab has entered the notch. In some embodiments, the blank provides tactile and/or audible feedback when the end inner panel springs away from the end outer panel after the tab has entered the notch.

The method may include deflecting the end inner panel toward the end outer panel to release the tab from the pocket.

In some embodiments, when the carton is erected, the end inner panel and the side inner panel each exert a spring force on the other.

According to some embodiments, the blank further includes an end foot panel connected to the end inner panel along a fifth fold line, the blank further includes a side foot panel connected to the side inner panel along a sixth fold line, and when the carton is erected, the side foot panel overlaps the end foot panel to capture the end foot panel between the side foot panel and the main panel and thereby inhibit the end inner panel from pivoting away from the end outer panel.

The method may further include bonding an outer decorative sheet to an outer surface of the substrate layer such that the outer decorative sheet covers at least a portion of each of the main panel, the end outer panel and the side outer panel. In some embodiments, bonding the outer decorative sheet to the outer surface of the substrate layer includes loose wrap bonding the outer decorative sheet to the substrate layer.

According to some embodiments, bonding the outer decorative sheet to the outer surface of the substrate layer includes: adhering the outer decorative sheet to the outer surface of the substrate layer with a flowable adhesive while the substrate layer is in a first position; thereafter bending the substrate layer into a second position such that the outer decorative sheet and the outer surface of the substrate layer slide relative to one another; thereafter setting the adhesive while the substrate is in the second position to thereby permanently affix the outer decorative sheet to the outer surface of the substrate layer with the set adhesive; and thereafter bending the substrate layer into a third position.

In some embodiments, when the outer decorative sheet is bonded to the substrate layer, the outer decorative sheet includes a corner section extending beyond the end outer panel and the side outer panel, and the corner section has a cross edge defining an oblique angle with each of the primary axis and the secondary axis.

According to some embodiments, at least some of the first, second, third, and fourth fold lines are of a first type and at least some of the first, second, third, and fourth fold lines are of a second type, wherein the fold lines of the first type exert a greater return spring force when folded than do the fold lines of the second type when folded. In some embodiments, the fold lines of the first type are creases in the substrate layer and the fold lines of the second type are lines of perforations in the substrate layer.

In some embodiments, the substrate layer includes a first corner panel connected to the end outer panel by a first corner fold line, and a second corner panel connected to the side outer panel by a second corner fold line and to the first corner panel by a third corner fold line. The method further includes adhering the first corner panel to the end outer panel or adhering the second corner panel to the side outer panel.

According to method embodiments of the invention, a method for forming a multi-ply unit for forming a carton includes providing a blank including a substrate layer, the substrate layer having an outer surface and a plurality of fold lines. The method further includes loose wrap bonding an outer decorative sheet to an outer surface of the substrate layer, including: adhering the outer decorative sheet to the outer surface of the substrate layer with a flowable adhesive while the substrate layer is in a first position; thereafter bending the substrate layer into a second position such that the the outer decorative sheet and the outer surface of the substrate layer slide relative to one another; thereafter setting the adhesive while the substrate is in the second position to thereby permanently affix the outer decorative sheet to the outer surface of the substrate layer with the set adhesive; and thereafter bending the substrate layer into a third position.

Further features, advantages and details of the present invention will be appreciated by those of ordinary skill in the art from a reading of the figures and the detailed description of the preferred embodiments that follow, such description being merely illustrative of the present invention.

BRIEF DESCRIPTION OF THE DRAWINGS

FIGS. 9A, 9B and 9D are enlarged, fragmentary perspective views of a corner region of the multi-ply unit. FIG. 9C is a fragmentary, cross-sectional view of the multi-ply unit taken along the line 9C-9C of FIG. 9B. FIG. 9E is a fragmentary, cross-sectional view of the multi-ply unit taken along the line 9E-9E of FIG. 9D.

DETAILED DESCRIPTION OF EMBODIMENTS OF THE INVENTION

Figure 1:
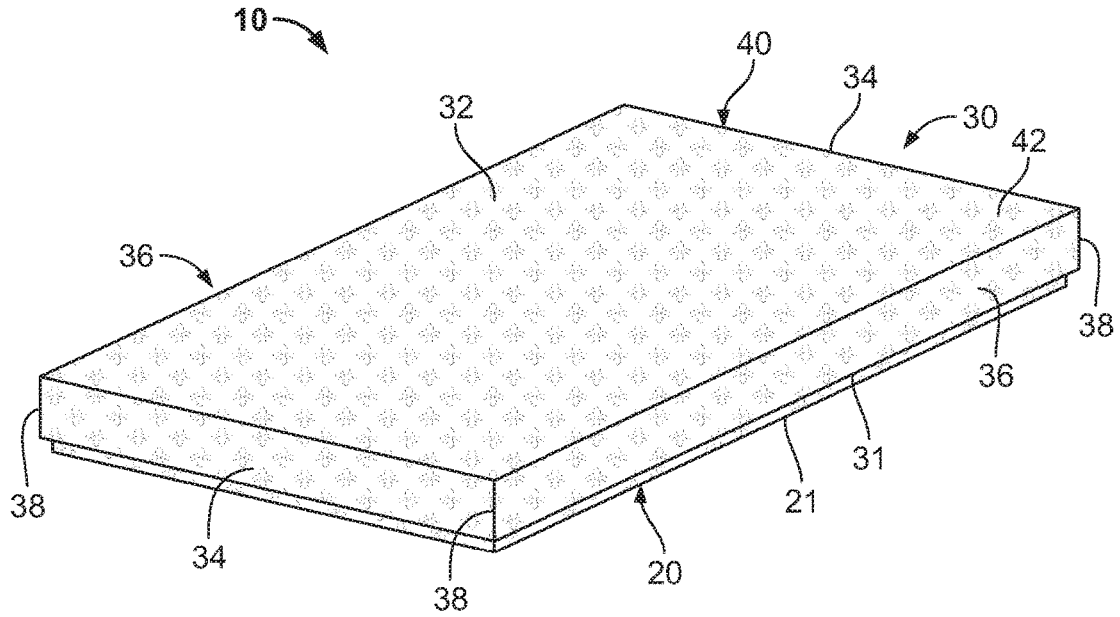
FIG. 1 is a top perspective view of a box assembly according to embodiments of the invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

The term "monolithic" means an object that is a single, unitary piece formed or composed of a material without joints or seams.

Figure 2:
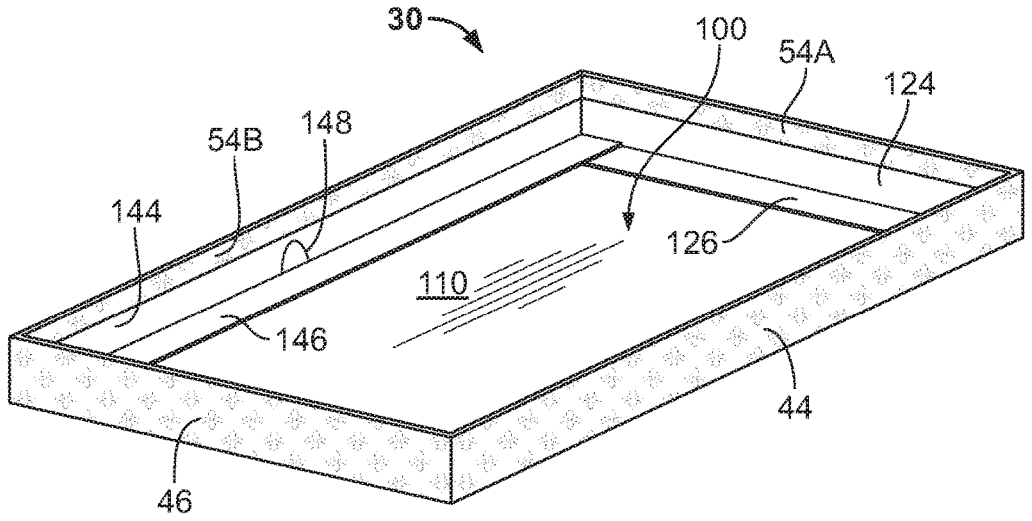
FIG. 2 is a bottom perspective view of a lid forming a part of the box assembly of FIG. 1.

With reference to FIGS. 1-10, a box assembly 10 (FIG. 1) according to embodiments of the invention is shown therein. The box assembly 10 includes a base carton 20 (hereinafter, the base 20) and a lid carton 30 (hereinafter, the lid 30; FIG. 2). The lid 30 slidably fits over the base 20 in a telescoping arrangement. The base 20 and the lid 30 collectively define a chamber within the box assembly 10 within which selected items may be contained.

The base 20 and the lid 30 each include a substrate structure and an outer decorative layer 40 overlying or covering the substrate structure. The box assembly 10 is thereby decorated or aesthetically enhanced by the outer decorative layer 40, and may give the impression of a box fully wrapped in the outer decorative layer 40. Moreover, in some embodiments, the outer decorative layers 40 are bonded to underlying substrate structures in only selected locations so that a substantial remainder of the outer decorative layer 40 remains loose, thereby providing the box assembly 10 with a loose wrapped appearance.

The base 20 has a bottom edge 21. According to some embodiments, the lower edge of 31 of the lid 30 is located at the same height as the bottom edge 21 or within about 0.25 inch of the bottom edge 21. This fully telescoping configuration between the base 20 and the lid 30 can further enhance the appearance of the box assembly 10 as a fully wrapped box that may look very similar to a traditional gift-wrapped packaged.

The base 20 and the lid 30 may be constructed in substantially the same manner with the exception of different dimensions to enable the above mentioned telescoping fit. The lid 30 will be described here below in greater detail. However, it will be appreciated that this description likewise applies to the base 20.

The erected lid 30 includes a central or main wall 32, a pair of opposed end walls 34, a pair of opposed side walls 36, and four corners 38 interposed between the adjacent end walls 34 and side walls 36. The walls 34, 36 extend orthogonally to the main wall 32. The end walls 34 extend orthogonally to the side walls 36.

Figure 5:
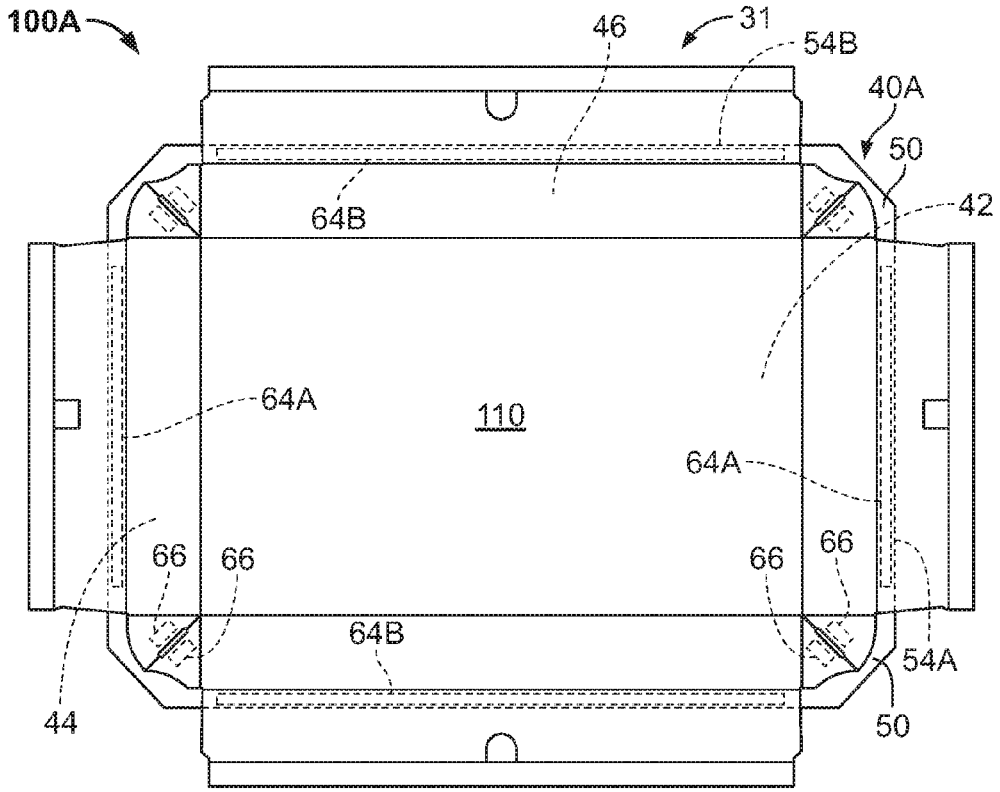
FIG. 5 is a top plan view of a multi-ply unit for forming the lid of FIG. 2 in a flat configuration, the multi-ply unit including the substrate layer blank of FIG. 3.
Figure 6:
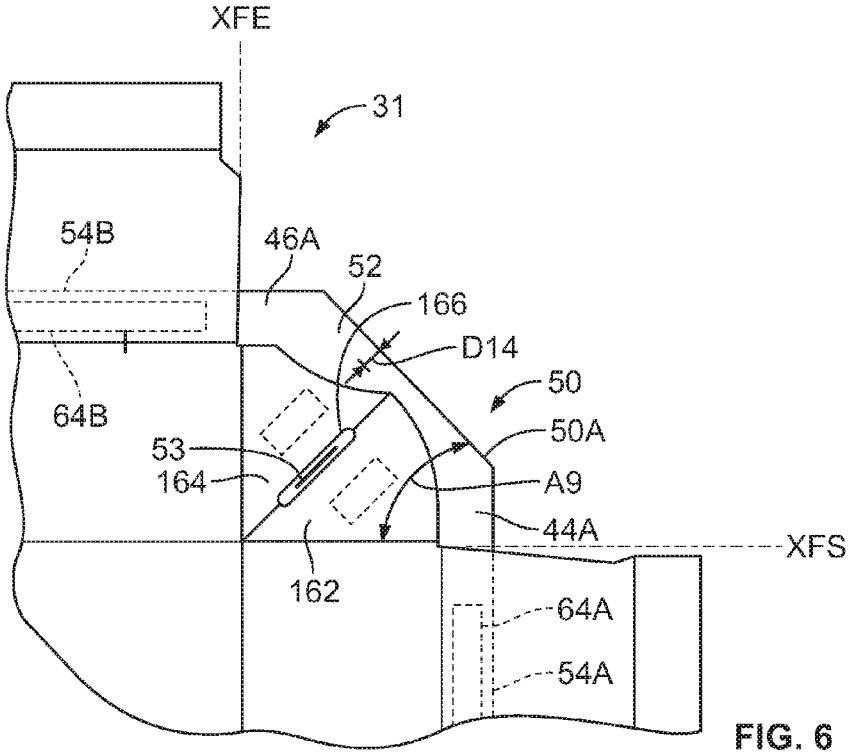
FIG. 6 is an enlarged, fragmentary top plan view of the multi-ply unit of FIG. 5.

The lid 30 is constructed from a foldable multi-ply unit 31. The multi-ply unit 31 is shown in FIGS. 5 and 6 in a flat configuration and in FIGS. 7 and 8 in a collapsed configuration. In FIGS. 1, 2 and 9E, the multi-ply unit 31 is shown in its assembled configuration as the lid 30.

The multi-ply unit 31 (and the assembled lid 30) includes a substrate layer 100, a decorative outer layer 40, and layers, strips or patches of adhesive 64A, 64B, 66. When the lid 30 is erected (as described in more detail below), the substrate layer 100 is configured as a rigid, three-dimensional erected substrate structure 33.

Figure 3:
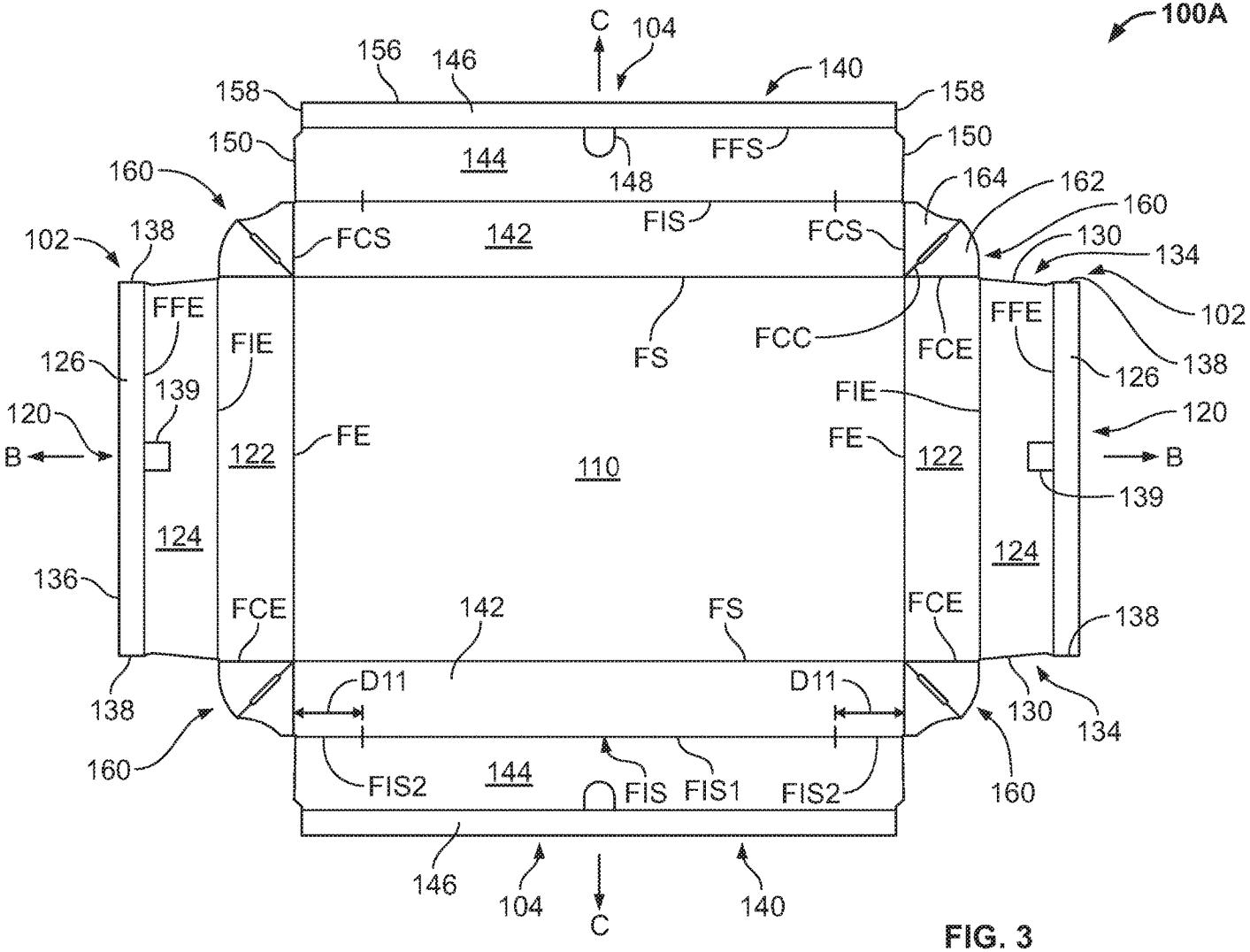
FIG. 3 is a top plan view of a substrate layer blank for forming the lid of FIG. 2.

With reference to FIG. 3, the substrate layer 100 is provided in the multi-ply unit 31 as a flat sheet or blank 100A of a semi-rigid, bendable material. The blank 100A includes a main panel 110, a pair of opposed end panels 120, a pair of opposed side panels 140, and four corner webs 160 interposed between the adjacent end panels 120 and side panels 140. The blank 100A has opposed ends 102 and opposed sides 104. The blank 100A defines a primary or longitudinal axis B-B extending from end 102 to end 102. The blank 100A defines a secondary, widthwise or lateral axis C-C extending from side 104 to side 104.

Each end panel 120 includes an outer panel 122, an inner panel 124, and a foot panel 126. The end outer panel 122 is connected to an end edge of the main panel 110 along a fold line FE. The outer panel 122 is also connected to a corner web 160 on either lateral end thereof along a fold line FCE. The outer panel 122 is connected to the inner panel 124 along a fold line FIE. The foot panel 126 is connected to the inner panel 124 along a fold line FFE.

Figure 4:
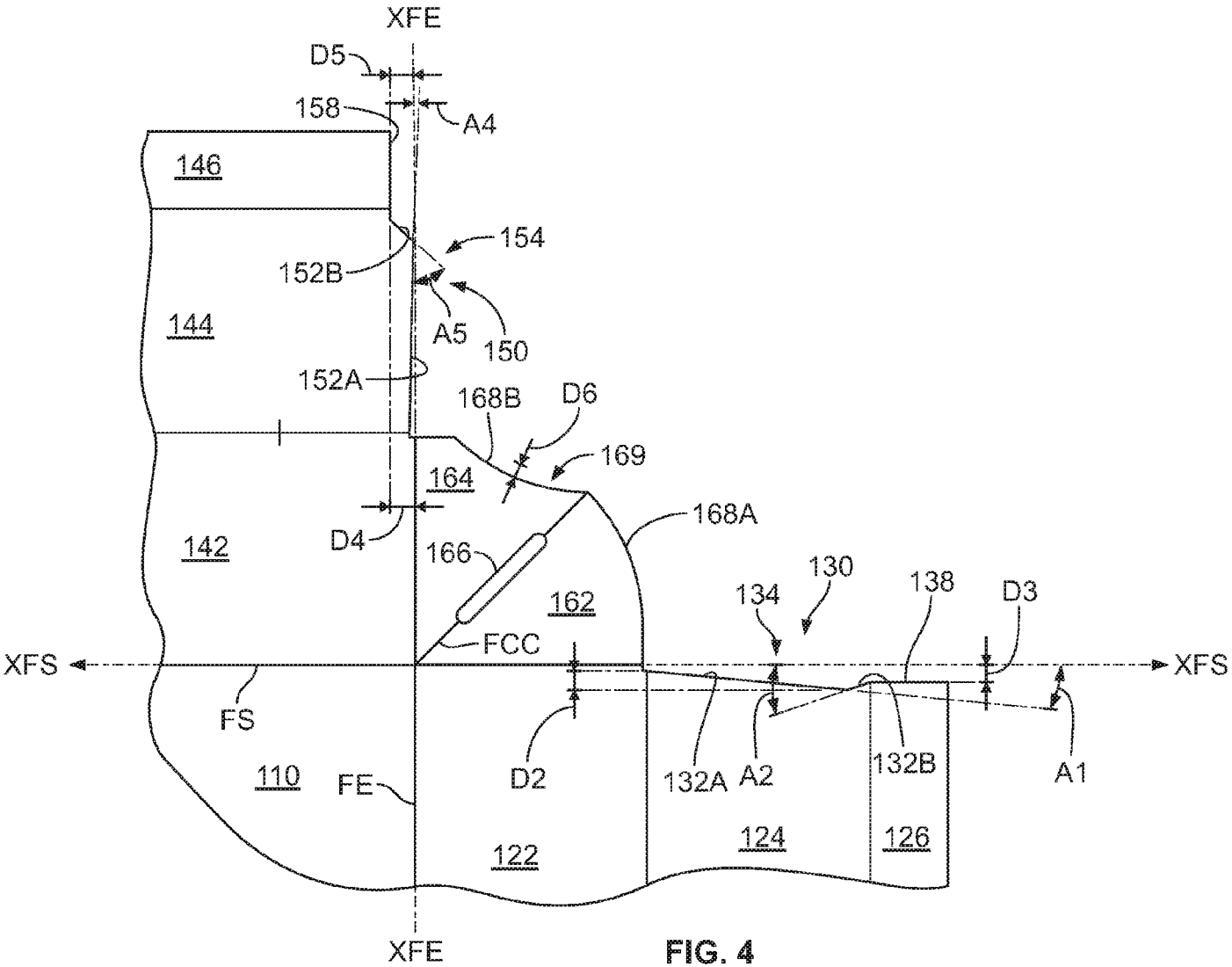
FIG. 4 is an enlarged, fragmentary top plan view of the substrate layer blank of FIG. 3.

The end inner panel 124 has opposed side edges 130. With reference to FIG. 4, each side edge 130 includes a proximal edge section 132A and a distal edge section 132B. The sections 132A, 132B collectively define a sidewardly opening notch 134.

A pull hole 139 is defined in the middle of the inner panel 124.

Each end foot panel 126 is defined by a foot terminal edge 136 and laterally opposed foot side edges 138 (FIG. 3).

Each side panel 140 includes an outer panel 142, an inner panel 144, and a foot panel 146. The outer panel 142 is connected to a side edge of the main panel 110 along a fold line FS. The outer panel 142 is also connected to a corner web 160 on either lateral end thereof along a fold line FCS. The outer panel 142 is connected to the inner panel 144 along a fold line FIS. The foot panel 126 is connected to the inner panel 124 along a fold line FFS.

Each side inner panel 144 has opposed side edges 150. With reference to FIG. 4, each side edge 150 includes a proximal edge section 152A and a distal edge section 152B. The sections 152A, 152B collectively define a sidewardly projecting tab 154. A pull hole 148 is defined in the middle of the inner panel 144.

Each side foot panel 146 is defined by a foot terminal edge 156 and laterally opposed foot side edges 158.

Each corner web 160 includes a corner end panel 162 and a corner side panel 164 joint along a fold line FCC that extends at an oblique angle (according to some embodiments, about 45 degrees) to the axes B-B and C-C. With reference to FIG. 4, a cutout slot 166 is defined between the panels 162, 164 along the axis of the fold line FCC. The panel 162 has a convex outer edge 168A. The panel 164 has a concave outer edge 168B. The edge 168B defines a sidewardly opening recess 169.

The decorative outer layer 40 is provided as a blank or sheet 40A including a main section 42, a pair of opposed end sections 44, a pair of opposed side sections 46, and corner sections 50 interposed between the adjacent end sections 44 and side sections 46. The decorative outer layer sections 42, 44, 46 and 50 overlie the substrate layer panels 110, 120, 140 and 160, respectively. The sheet 40A lies in a plane substantially parallel to the plane of the blank 100A. In the erected lid 30, each section of the sheet 40A lies in a plane substantially parallel to the corresponding panel 110, 122, 124, 142, 144 that it covers.

An overhang section 52 of each corner section 50 overhangs or projects outwardly beyond the corresponding corner panel 160. Each overhang section 52 includes an end edge 44A, a side edge 46A, and a corner cross edge 50A.

Each corner section 50 also includes a slit 53 (e.g., as shown in FIG. 6). Each slit 53 is aligned with and overlapped by the adjacent cutout slot 166.

Each of the end sections 44 includes an interior section 54A overlapping the inner panel 124 of the associated end panel 120. Each of the side sections 46 includes an interior section 54B overlapping the inner panel 144 of the associated side panel 140.

With reference to FIG. 5, an end strip of adhesive 64A is interposed between each interior section 54A and the adjacent inner panel 124. A side strip of adhesive 64B is interposed between each interior section 54B and the adjacent inner panel 144. Strips or patches of adhesive 66 are interposed between each corner section 50 and the underlying corner panels 162, 164. The decorative outer layer 40 is thereby bonded to the outer surface of the substrate layer 100 by the adhesive 64A, 64B, 66 as discussed in more detail below.

The substrate layer 100 may be formed of any suitable material. According to some embodiment, the substrate 100 layer is formed of a cellulosic material. In some embodiments, the substrate layer 100 is formed of paperboard or card stock. In some embodiments, the substrate layer 100 has a thickness T2 (FIG. 9C) in the range of from about 0.01 to 0.03 inch. In some embodiments, the thickness T2 is in the range of from 116 point to 50 point. According to some embodiments, the substrate layer 100 is unitary. In some embodiments, the substrate layer 100 is monolithic. The substrate layer 100 may be formed by diecutting a larger sheet of material to form the blank 100A, for example.

In some embodiments, the substrate layer 100 is formed of paper stock or paperboard selected from the group consisting of kraft pack, clay coated news back (CCNB), clay coated kraft back (CCKB), solid unbleached sulfate (SUS), solid bleached sulfate (SBS), and/or bending chip paperboard.

The decorative outer layer 40 may be formed of any suitable material. According to some embodiment, the layer 40 is formed of a cellulosic material. In some embodiments, the decorative outer layer 40 is formed of paper. In some embodiments, the decorative outer layer 40 has a thickness T3 (FIG. 9C) in the range of from about 0.001 to 0.008 inch. According to some embodiments, the decorative outer layer 40 is unitary. In some embodiments, the decorative outer layer 40 is monolithic. The decorative outer layer 40 may be formed by diecutting a larger sheet of material to form the blank 40A, for example.

The adhesives 64A, 64B, 66 may be any suitable adhesive or glue. Suitable adhesives may include a water based adhesive such as WE 1227AN adhesive available from Palmetto Adhesives of Greenville, S.C. As discussed below, in some embodiments the adhesive 64A, 64B, 66 is an adhesive that requires at least a prescribed length of time to cure and adhere the layers 100, 40 to one another.

The adhesives 64A, 64B, 66 may be applied to the blank 100A and/or the sheet 40A using any suitable technique such as extrusion, spraying, rolling, wiping, painting or printing.

The fold lines FE, FCE, FIE, FFE, FS, FCS, FIS, FFS, FCC may be fold lines of any suitable type or construction. In some embodiments, the fold lines FE, FCE, FIE, FFE, FS, FCS, FIS, FFS, FCC are preformed fold lines that enable and facilitate a preferential line of bending between and at the boundaries of the panels joined thereby such that, when the panels are relatively folded about one another, the substrate layer 100 will distinctly and preferentially bend along the linear fold line. For example, in some embodiments the fold lines FE, FCE, FIE, FFE, FS, FCS, FIS, FFS, FCC are constructed such that an unskilled person folding the lid 30 as described below can do so by hand without aid of tools or skilled manipulation technique.

It will be appreciated that the fold lines FE, FCE, FIE, FFE, FS, FCS, FIS, FFS, FCC also serve as boundary lines for the panels 110, 122, 124, 126, 142, 144, 146, 162, 164. In some embodiments, at least some of the fold lines FE, FCE, FIE, FFE, FS, FCS, FIS, FFS, FCC are of different types of preformed fold lines from one another. In some embodiments, some of the preformed fold lines FE, FCE, FIE, FFE, FS, FCS, FIS, FFS, FCC are of a first type and some are of a second type. In some embodiments, the first type of fold line retains an elastic return bias or force when folded 180 degrees, and the second type when folded 180 degrees retains less elastic return bias or force than the first type when folded 180 degrees. In some embodiments, the first type of fold line is a crease or matrix and the second type of fold line is a line of perforations. The creases may be formed by pressing or embossing the substrate layer 100 along the fold line to compress the material. The perforation lines may be formed by piercing partially or fully through the substrate layer 100.

With reference to FIG. 4, it can be seen that each edge 132A is sloped inwardly at an oblique angle A1 relative to the axis XFS-XFS of the fold line FS. As a result, each inner panel 124 tapers inwardly in a direction away from the main panel 110 along the axis B-B (FIG. 3). According to some embodiments and as shown, the second edge 132B is sloped outwardly at an oblique angle A2 (FIG. 4) relative to the axis XFS-XFS of the fold line FS so that the edges 132A, 132B define a V-shaped profile.

According to some embodiments, the angle A1 (FIG. 4) is in the range of from about 3 to 7 degrees. According to some embodiments, the angle A2 is in the range of from about 20 to 40 degrees.

According to some embodiments, the maximum depth D2 (FIG. 4) of the notch 134 along an axis parallel to the axis C-C (FIG. 3) from the fold line FS is in the range of from about 0.15 to 0.25 inch.

According to some embodiments, the entireties of the inner panel 124 and the foot panel 126 of each end panel 120 are positioned between the axes XFS-XFS of the side fold lines FS. According to some embodiments, each foot panel 126 is inset a distance D3 (FIG. 4) from the adjacent side fold line FS in the range of from about 0.1 to 0.2 inch.

With reference to FIG. 4, it can be seen that each edge 152A is sloped outwardly at a small oblique angle A4 relative to the axis XFE-XFE of the fold line FE. As a result, each inner panel 144 tapers outwardly in a direction away from the main panel 110 along the axis C-C. According to some embodiments and as shown, the second edge 132B is sloped inwardly at an oblique angle A5 (FIG. 4) relative to the axis XFE-XFE of the fold line FE so that the edges 152A, 152B define an inverted V-shaped profile.

According to some embodiments, the angle A4 (FIG. 4) is in the range of from about 0.5 to 2 degrees. According to some embodiments, the angle A5 is in the range of from about 40 to 50 degrees and, in some embodiments is about 45 degrees.

According to some embodiments, the maximum projection distance D4 (FIG. 4) of the tab 154 along an axis parallel to the axis C-C from the end edge 158 of the foot panel 146 is in the range of from about 0.1 to 0.3 inch.

According to some embodiments, the entireties of the inner panel 144 and the foot panel 146 of each side panel 140 are positioned between the axes XFE-XFE of the end fold lines FE. According to some embodiments, each foot panel 146 is inset a distance D5 (FIG. 4) from the adjacent end fold line FE in the range of from about 0.1 to 0.3 inch. According to some embodiments, the inset distance D5 of the side foot panels 146 is greater than the inset distance D3 of the end foot panels 126.

According to some embodiments, the depth D6 (FIG. 4) of each corner recess 169 is in the range of from about 0.08 to 0.16 inch.

According to some embodiments, the pull holes 148, 139 each have a size in the range of from about 0.25×0.25 inch to 0.75×0.75 inch.

According to some embodiments, the outer decorative layer 40 is bonded to the substrate layer 100 using the following procedure.

The adhesive strips 64A, 64B, 66 are applied to the outside surface of the blank 100A in the locations described above and as shown in FIG. 5 about the perimeter of the blank 100A. The sheet 40A is applied to the outside surface of the blank 100A and the glue strips 64A, 64B, 66 in registry as shown in FIG. 5 while the glue strips 64A, 64B, 66 are still flowable (i.e., fluid, liquid or viscous and not yet cured or set).

Figure 7:
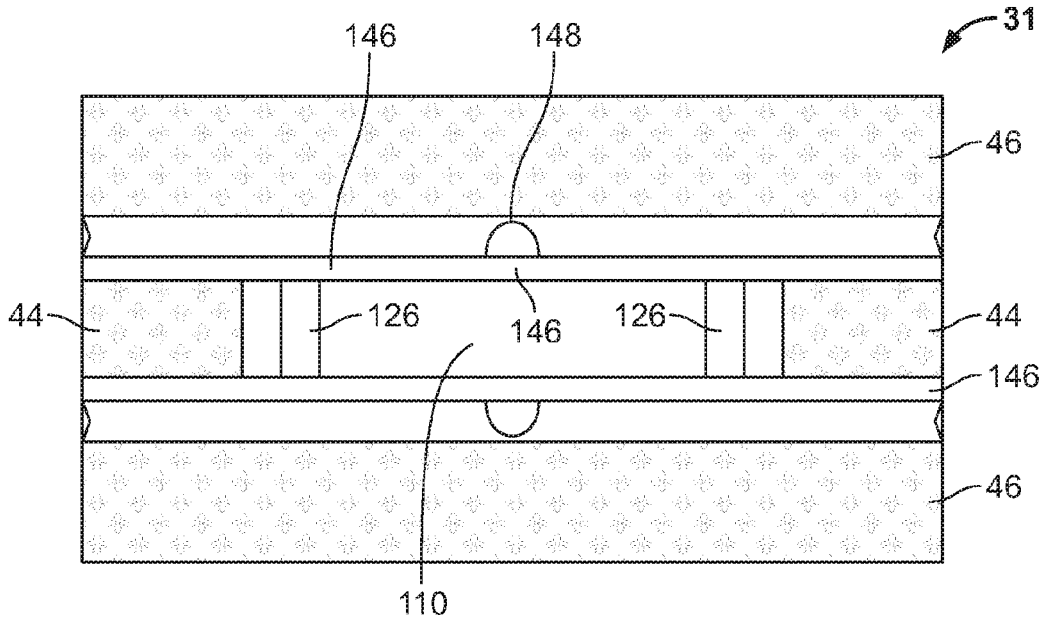
FIG. 7 is a top plan view of the multi-ply unit of FIG. 5 in a collapsed configuration.

While the adhesive strips 64A, 64B, 66 remain flowable, the end panels 120 are folded about 180 degrees about their respective fold lines FE and the side panels 140 are folded about 180 degrees about their respective fold lines FS into the collapsed configuration of FIG. 7. The sheet 40A remains adhered to the blank 40A and the sections 44, 46, 50 therefore remain secured to their associated panels 124, 144, 160. However, when the end panels 120 are folded, the sheet 40A is pull taut along the axis B-B by the radiuses of the bends or folds at the fold lines FE. Likewise, when the side panels 140 are folded, the sheet 40A is pulled taut along the axis C-C by the radiuses of the bends or folds at the fold lines FS. Because the adhesive strips 64A, 64B, 66 are adherent but still flowable and the sheet 40A is substantially inelastic, the panels 120, 140, and 160 slip, shift, move or slide outwardly along the axes B-B, C-C relative to the sheet sections 44, 46 and 50. Restated, the sheet sections 44, 46 and 50 are pulled or drawn inwardly along the axes B-B, C-C so that the sheet sections 44, 46 and 50 slip, shift move or slide inwardly relative to the panels 120, 140, 160.

The blank 100A and the sheet 40A are then retained in the collapsed configuration until the adhesive strips 64A, 64B, 66 have cured or set to securely hold the sections 44, 46, 50 in their positions on the blank 100A to form the multi-ply unit 31. According to some embodiments, the adhesive strips 64A, 64B, 66 have a cure time of at least about 15 seconds, in some embodiments in the range of from about 15 to 900 seconds and, in some embodiments, in the range of from about 45 to 75 seconds.

The multi-ply unit 31 can then be assembled into the lid 30, retained in the collapsed configuration, or reconfigured to a flat configuration (FIG. 5).

Figure 8:
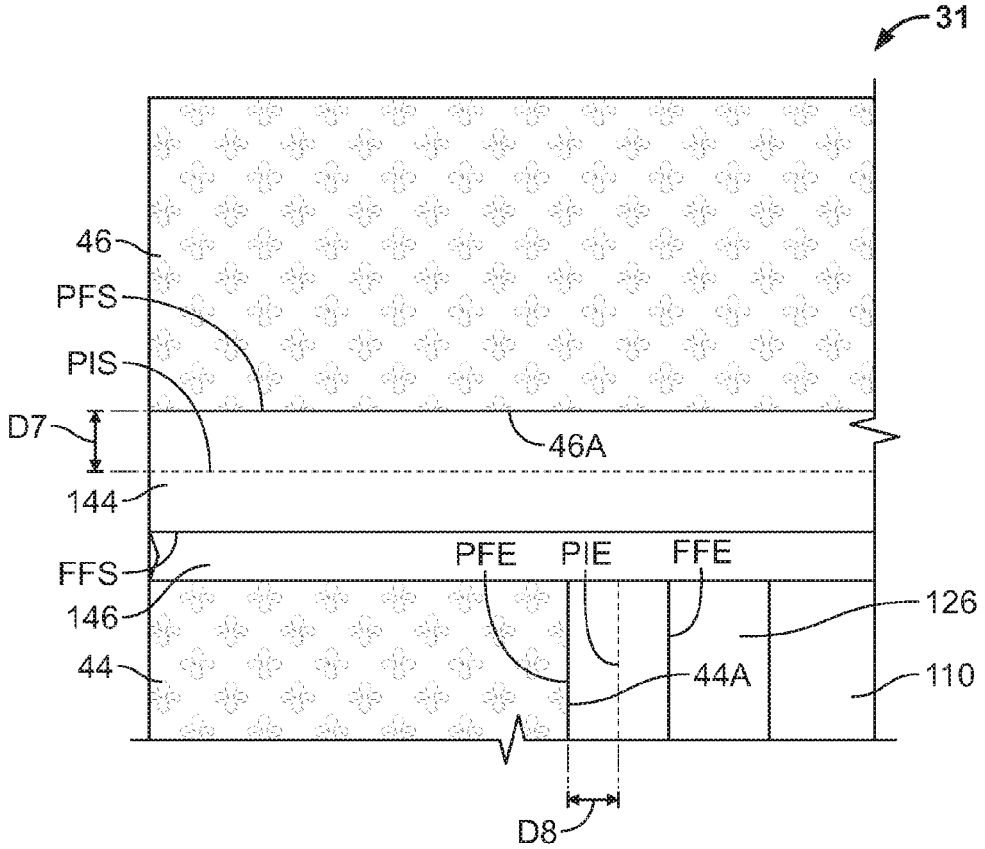
FIG. 8 is an enlarged, fragmentary top plan view of the multi-ply unit of FIG. 7.

FIG. 8 further illustrates the effect of the above-described method of assembly on the resulting multi-ply unit 31, and in particular the registry between the sheet 40 and the blank 100. Prior to folding the panels 120, 140, the outer edge 46A of each side section 46 is located at an initial position PIS. By folding the panels 120, 140, the outer edge 46A of each side section 46 is shifted toward the main section 110 along the axis C-C, and is thereby re-located to a final, shifted position PFS. According to some embodiments, the shift or displacement distance D7 (FIG. 8) between the initial position PIS and the final position PF is in the range of from about 0.05 to 0.2 inch.

Similarly, prior to folding the panels 120, 140, the outer edge 44A of each end section 44 is located at an initial position PIE. By folding the panels 120, 140, the outer edge 44A of each end section 44 is shifted toward the main section 110 along the axis B-B, and is thereby re-located to a final, shifted position PFE. According to some embodiments, the shift or displacement distance D8 (FIG. 8) between the initial position PIE and the final position PFE is in the range of from about 0.05 to 0.2 inch.

The small shifting of the sheet 40A relative to the blank 100A causes additional area or slack of the sheet 40A to be located in the region bounded by the fold lines FE, FS when the panels 120, 140 are folded into the erected configuration of the substrate structure 33. The foregoing method and resulting edge relocation can thereby serve to reduce or relieve some of the tension in the decorative outer layer 40 in the assembled lid 30. Without this reduction, the tension load applied to the outer layer 40 may apply a corresponding compression load on the substrate layer 100. Such a compression load may cause the lid 30 to undesirably and unattractively warp, bow, bulge or twist. Such deformation and compressive stress may cause the carton to reopen. While some tension in the outer layer 40 is desirable (and may be retained by the method described above) in order to hold the outer layer taut, too much tension in the outer layer 40 may render the outer sheet 40 overly susceptible to tearing.

As discussed herein, in some embodiments, the outer decorative layer 40 is loose wrapped onto the lid 30 in the final assembly of the erected lid. In some embodiments, the adhesive 64A, 64B, 66 contacts only from about 1% to 10% of the underside surface area of the outer decorative layer 40 (i.e., the remainder of the outer decorative layer 40 remains unadhered to the substrate layer 100) and, in some embodiments, in the range of from 2% to 6%. In some embodiments, and as shown, the entirety of the underside of the outer decorative layer main section 42 covering the main panel 110 is nonadhered to the main panel 110.

The multi-ply unit 31 may be used as follows to form the assembled lid 30.

The multi-ply unit 31 may be folded 180 degrees at each of fold lines FE, FIE, FS, FIS to pre-bend these fold lines and then returned to the flat configuration of FIG. 5.

Figure 9A:
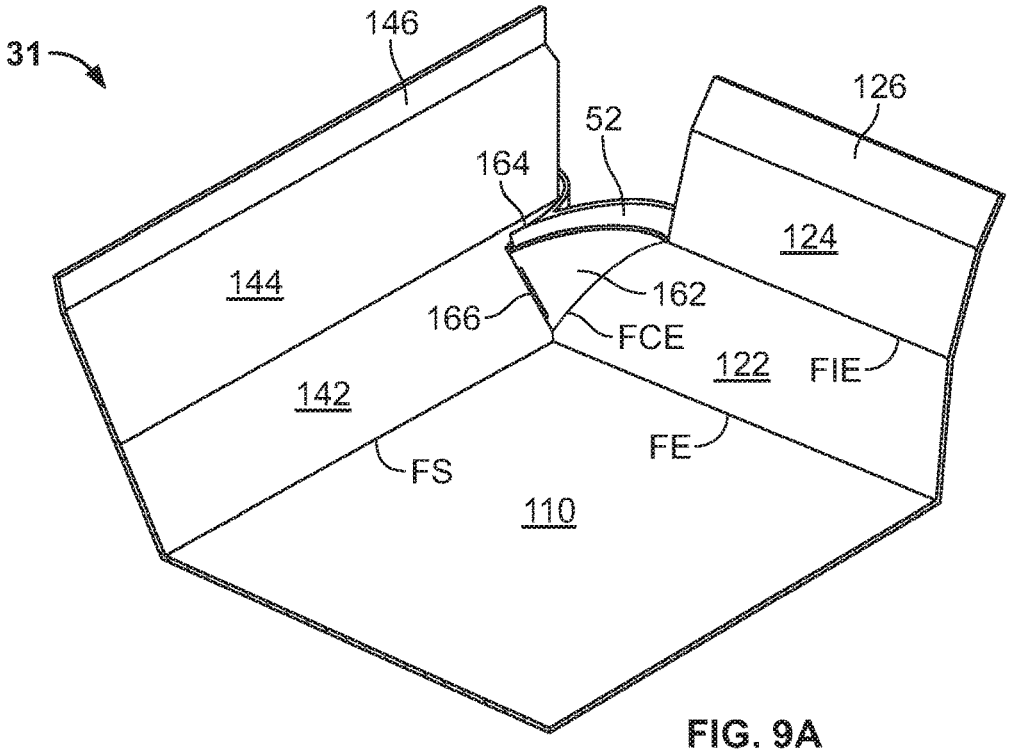
FIGS. 9A-9E illustrate steps for erecting the lid of FIG. 2 from the multi-ply unit of FIG. 5.

On one side of the multi-ply unit 31, the opposed corner webs 160 are pushed and collapsed inwardly as shown in FIG. 9A. Each corner side panel 164 is pressed against the inner surface of the outer panel 142, which tends to stand up the panels 122 and 142 about the fold lines FE and FS to approximately a right angle to the main panel 110.

Figure 9B:
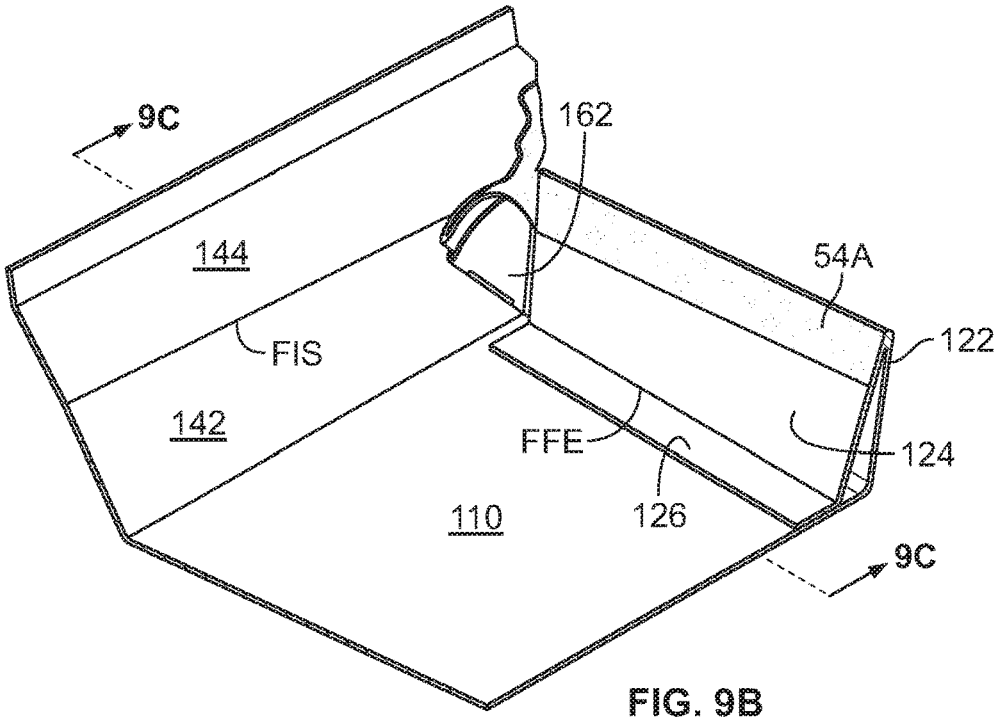
Figure 9C:
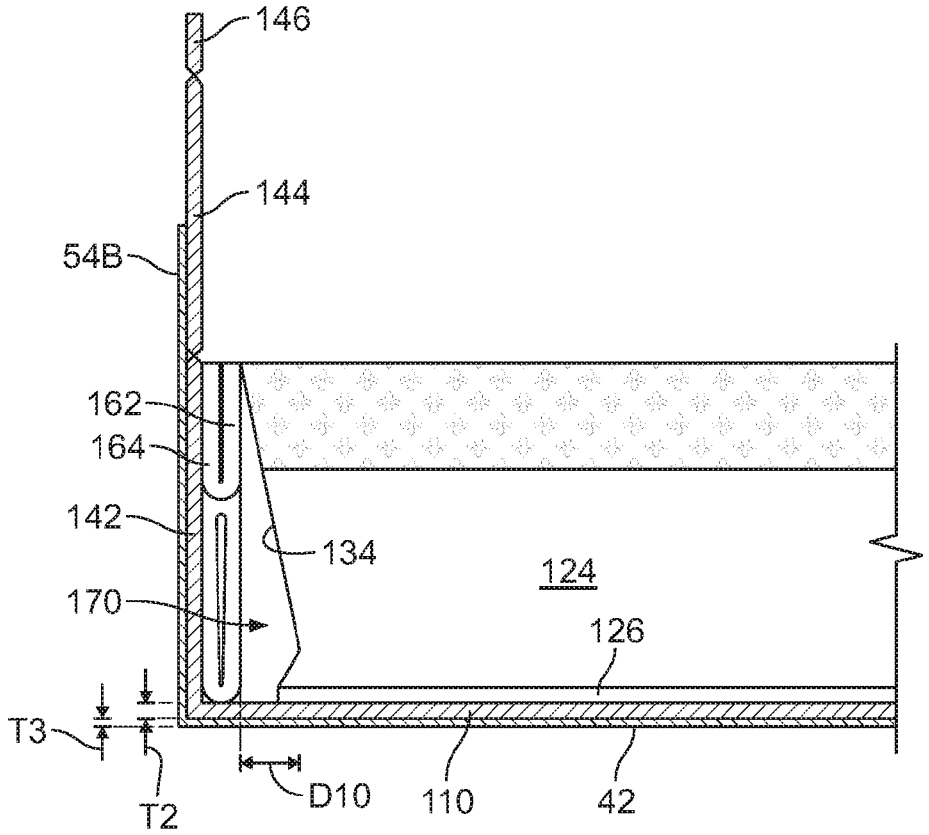

Each end inner panel 124 is then folded about its fold line FIE onto the adjacent end outer panel 122 as shown in FIG. 9B. The end inner panel 124 then faces the end side panel 122 as shown in FIG. 9B. Each foot panel 126 bends about the fold line FFE to lie substantially flat against the main panel 110. As shown in FIG. 9C, the notch 134 of each inner panel 124 and the adjacent corner end panel 162 define a lock slot or pocket 170. The pocket 170 has a depth D9 (FIG. 9E) parallel to the plane of the side outer panel 142 and a width D10 (FIG. 9C) orthogonal to the plane of the side outer panel 142.

Figure 9D:
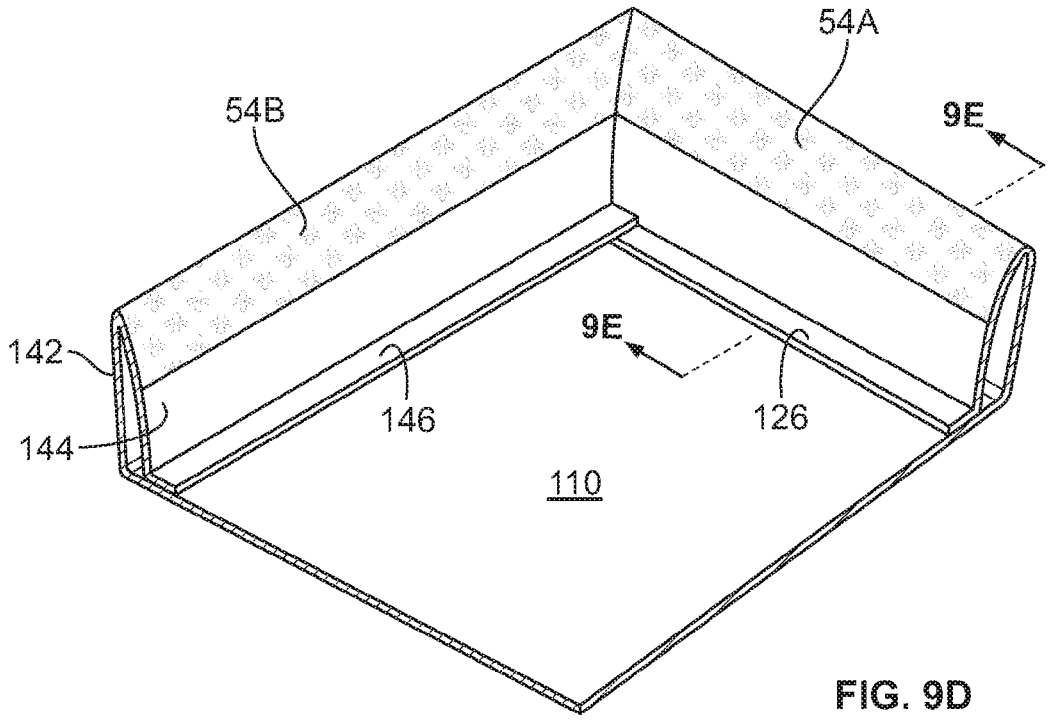
Figure 9E:
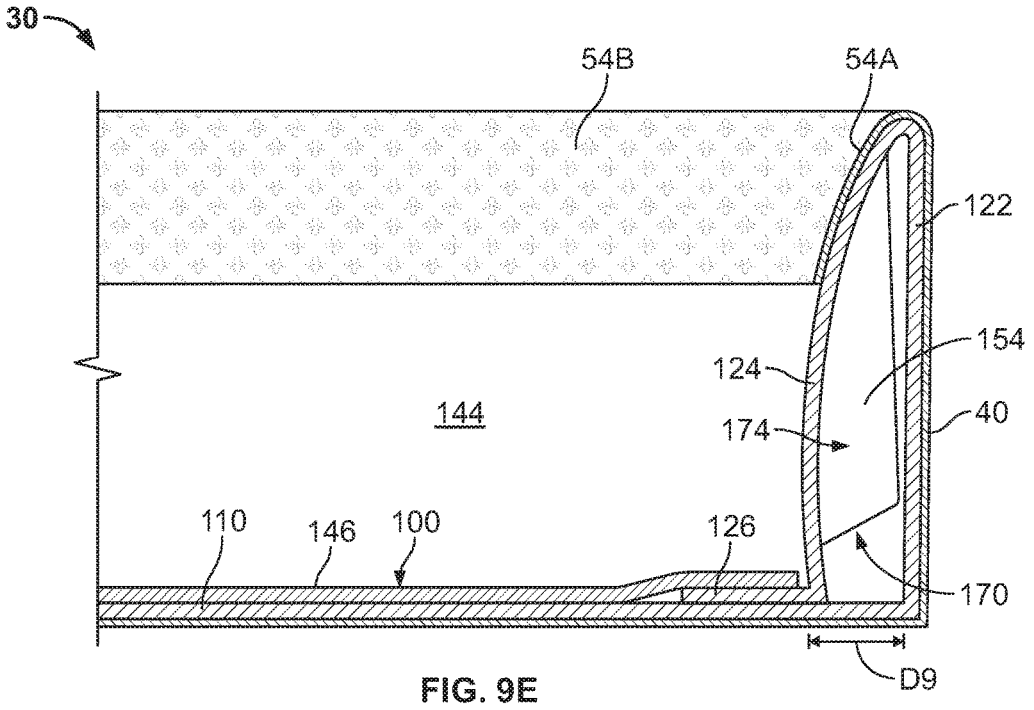

The side inner panel 144 is folded about its fold line FIS onto the adjacent outer panel 142 as shown in FIG. 9D. The side inner panel 144 then faces the side outer panel 142 as shown in FIG. 9D. The foot panel 146 bends about the fold line FFS to lie substantially flat against the main panel 110 and an end section of each foot panel 126. As shown in FIG. 9E, each tab 154 of the inner panel 144 is received or inserted into and seats in a lock pocket 170 at each end. The corner webs 160 are captured behind the side inner panel 144. The side foot panel 146 lays on top of the end foot panels 126. In this way the corners become interlocked. The side inner panels 144 cannot extend because the tabs 154 are blocked by the end panel slots 134 and the end inner panels 124 cannot extend because they are blocked by the ends of the side foot panel 146.

This step may be executed after or substantially simultaneously with the step of folding the end inner panels 124 down as described above. For example, the side inner panel 144 may bear against the end panels 124 as the panel 144 is folded, thereby forcing the panels 124 to fold into position.

The foregoing folding procedure is repeated using the opposing side panel 140. Each of the four corners is thereby placed in its locked position to maintain the lid 30 as a rigid structure. It will be appreciated that in the case of the second side panel 140, the end inner panels 124 will already be substantially bent into position before initiating the folding process.

At each corner, the tab 154, the notch 134, and the foot panels 126, 146 form a robust interlock facilitated by elastic or spring force exerted by the inner panels 124, 144. The panels 124, 144 are elastically deflected at the folds FIE, FIS and/or along their width by residual resilience so that they tend to push away from the outer panels 122 and 142, respectively.

As a result, the lock tabs 154 are positively pressed into the base of each notch 134 of each lock pocket 170.

Also, the end inner panel 124 presses against the end of the foot panel 146 such that a standoff or air gap 174 (FIG. 9E) is present between the inner panel 122 and the outer panel 122. This gives the lock pocket 170 a corresponding depth parallel to the axis B-B to receive and hold a substantial length of the lock tab 154. That is, the partial re-extension of the end inner panels 124 allows the side panel tabs 154 to be more deeply engaged into the lock pockets 170 and this makes the interlocked corner joints more stable and less likely to be inadvertently disengaged.

The foot panel 144 in turn holds down the foot panels 126 and limits outward displacement of the inner panels 124. As discussed above, each foot edge 158 is inset a distance D5 (FIG. 4). This inset defines a gap 172 between the foot panel 146 and the end outer panel 122 that permits the end inner panel 124 to deflect away from the panel 122 a controlled or prescribed distance so that the air gap 174 is reliably formed.

According to some embodiments, as the side panel 140 is folded as described, the lock tabs 154 press against and elastically deflect the inner panels 124 toward the outer panels 122 until the lock tabs 154 clear the edges 130, whereupon the inner panels 124 are released to snap out away from the panels 122. In this way, the interlock mechanism provides tactile feedback and/or audible feedback to the user indicating that a positive interlock has been achieved.

The interlock between the lock features 134, 154 and the panels 124, 144 can be selectively released by the user by pressing the end inner panel 124 toward the outer panel 122 at a location proximate the corresponding corner, thereby closing the gap 174. The edge 130 will slide over the lock tab 154 until the edge of the lock tab 154 clears the edge 130, whereupon the elastically deflected inner panel 144 will spring away from the outer panel 142. In this way, the interlock mechanism provides tactile feedback and/or audible feedback to the user indicating that a positive interlock has been released.

The arrangement of the interlocking components and the air gap 174 provides the inner wall 124 with room to deflect in normal use without inadvertently and undesirably unlocking. The lid 30 can thus remain rigid until deliberately released and broken down.

By unlocking the interlocked corners as described above, the multi-ply unit 31 can be returned to the flat configuration (FIG. 5) or the collapsed configuration (FIG. 7) for storage and/or re-use. The multi-ply unit 31 can be re-used by reassembling the lid 30 using the steps described above. The lid 30 may be disassembled and reassembled multiple times.

As discussed above, in some embodiments, some of the fold lines FE, FCE, FIE, FFE, FS, FCS, FIS, FFS, FCC are of a first type that retains an elastic return bias or force when folded 180 degrees, and some of the fold lines FE, FCE, FIE, FFE, FS, FCS, FIS, FFS, FCC are of a second type that retains less elastic return bias or force than the first type when folded 180 degrees. In some embodiments, the first type of fold line is a crease or matrix and the second type of fold line is a line of perforations. In the discussion below, the fold lines are described as creases and perforation lines;

however, in other embodiments the fold lines thus described may be fold lines of a first type (relatively greater return bias) and of a second type (relatively lesser return bias) other than creases and perforation lines.

In general, a perforation line is used where it is desired to have a low residual return or straightening force between the adjacent panels and a crease is used where a relatively high return or straightening force is desired between adjacent panels. In other words, a crease feature is used where it is desirable for the bend at that location to be more elastic and a perforated feature is used where a more plastic bend is desired. Also, a crease is generally stronger than a perforation line and can withstand a larger amount of flexure and stress before tearing than can a perforation line. When the box is in the final assembled condition, at locations where the external layer 40 is pulled tightly against a corner, the external layer 40 will appear more uniform and attractive where it is pulled against a crease rather than where it is pulled against a perforation line. Strategic selection of the types of boundary or fold lines between panels can provide specific advantages to the appearance and performance of the product. The following is a description of the purpose of each boundary feature between each of the adjacent panels of the blank 100A in accordance with some embodiments of the invention. These features may all be employed in a given box, may be used individually in a given box, or may be used in some other combination in a given box.

Each foot panel 126, 146 has a perforation line for its boundary or fold line FFE, FFS with the adjacent inside panel 124, 144 to make this bend easy to form and to minimize the straightening force that can contribute to unattractive bowing of the sides and ends of the final assembled box.

The fold lines FE, FS between the outer panels 122, 142 and the main panel 110 are perforation lines to make these bends easy to form and to minimize the residual straightening of these panels that can result in unattractive bowing of the sides and ends of the final assembled box.

The fold line FIS (FIG. 3) between the outer panel 142 and the inner panel 144 of each side panel 140 includes a central section FIS1 and end sections FIS2 forming the opposed ends of the fold line FIS. The central section FIS1 makes up most of the length of the fold line FIS and is a perforation line. The end sections FIS2 are creases. According to some embodiments, the length D11 (FIG. 3) of each creased section FIS2 is in the range of from about 0.5 to 2 inches and, in some embodiments, in the range of from about 0.75 to 1.25 inches. Using a perforation line for most of this boundary minimizes the residual straightening to aid the final assembly and also minimizes the bowing of the sides of the final box assembly. The ends FIS2 of these boundaries transition to creases because in the final assembled box the outer layer 40 adjacent to these bends is relatively tight (i.e., in a high stress condition) and is therefore more attractive and less likely to tear if these locations have creases rather than if these locations were perforated. When the thin outer layer 40 (e.g., paper) is pulled tight against a perforated corner, the perforation lines can show through the outer layer 40 to some extent and this is undesirable. Also, the relatively high residual straightening force near the corners helps to maintain the slot and tab joint of the final assembled box.

The fold line FIE between the inner panel 122 and the outer panel 124 of each end panel 120 is a crease. This is because a relatively high residual straightening force is desirable at these locations. This high residual straightening force can result in a tactile and audible "click" upon the insertion of the side panel tabs 154 into the end panel slots 134. Also, this relatively high residual straightening force helps maintain the slot and tab joint of the final assembled box. Because the end panels 120 are relatively short in length in comparison to the side panels 140, the additional straightening force resulting from this crease feature does not result in significant bowing of the ends in the final box configuration.

The fold lines FCE, FCS between each corner web 160 and the adjacent outer panels 122, 142 are creases rather than perforation lines. This is because in the final assembled box the thin outer layer 40 (e.g., paper) at these locations is in a relatively high stress condition and therefore is less likely to tear and will appear more attractive if these are crease corners rather than perforated.

The corner panels 162, 164 are bisected by a boundary that is intended to be as easy to bend as possible with a minimal straightening force, both of which help simplify final assembly by the user. This boundary consists of the slot 166 with a perforation line FCC at each end. This configuration results in the minimal amount of straightening force that is practically possible at this location. According to some embodiments, the length of each perforation line FCC is in the range of from about 0.25 to 1 inch. According to some embodiments, the length of the slot 166 is in the range of from about 0.1 to 1.5 inches.

As discussed above, each corner web 160 includes two roughly pie shaped panels 162, 164. In the final folded box configuration, the panels 162, 164 are folded against each other and tucked between the inner panel 144 and the outer panel 142 of the side panel 140. Each panel 164 has a concave outer perimeter or edge section 168B. This concave perimeter provides a relief for the thin outer layer 40 (e.g., paper) when the box is folded in to the final box configuration. This helps to reduce binding and crumpling of the outer layer 40 during the final folding operation. Each panel 162 has a convex outer perimeter or edge section 168A. In the final folded box configuration, the edge section 168A is intended to be tight against the inside of the bend between the inner panel 144 and the outer panel 142 of the side panel 140. This helps insure a tight corner joint and helps prevent the ends of the final box from tilting outward.

With reference to FIG. 6, each corner edge 50A is cut back from a right angle corner. The corner edge 50A forms an oblique angle A9 with each of the axes XFE-XFE and XFS-XFS of the fold lines FE and FS. In some embodiments and as shown, the angle A9 is about 45 degrees.

Shaping the corner portion of the outer layer 40 (e.g., by removing material at the corner) can reduce or prevent excessive bunching and binding of the thin outer layer 40 (e.g., paper) into the corners during final assembly by the product user. This makes the box easier to assemble and it provides a more attractive corner in the finished box. The corner edge 50A is spaced a distance D14 (FIG. 6) from the corner web 160 along the fold line FCC. According to some embodiments, the distance D14 is in the range of from about 0.0625 to 0.25 inch and, in some embodiments, about 0.125 inch. This location of the outer layer corner edge 50A can ensure that there is still enough of the outer layer 40 to cover the corners of the box in the final folded configuration.

The slits 53 in each corner section 50 of the sheet 40A can help to relieve tension in the corner section 50 when the corner section 50 is folded to form the corner.

The multi-ply unit 31 (or a plurality thereof) may be (and, according to some method embodiments is) stored and shipped in the flat configuration (FIG. 5) to save space, and then assembled on-site by the end user. Alternatively, the multi-ply unit 31 (or a plurality thereof) may be (and, according to some method embodiments is) stored and shipped in the collapsed configuration (FIG. 7) to save space, and then assembled on-site by the end user. Alternatively, the multi-ply unit 31 (or a plurality thereof) may be stored and shipped in the assembled configuration (FIG. 2). In each case, the multi-ply unit 31 can be broken down and returned to the flat configuration or the collapsed configuration for subsequent storage or transport for later re-use.

In the collapsed configuration, the end panels 120 and side panels 140 are folded over the base panel 110 so that the collapsed box has substantially the same foot print as the base panel 110. Alternatively, the end panels 120 may be folded over the side panels 140.

As discussed above, the entireties of the inner panel 124 and the foot panel 126 of each end panel 120 are positioned between the axes XFS-XFS of the side fold lines FS (i.e., no portion of the end panel 120 extends laterally beyond the adjacent fold line FS). As a result, the end panels 120 will not be damaged by or inhibited from being folded into the collapsed configuration.

Likewise, the entireties of the inner panel 144 and the foot panel 146 of each side panel 140 are positioned between the axes XFE-XFE of the end fold lines FE. As a result, the side panels 140 will not be damaged by or inhibited from being folded into the collapsed configuration or an alternative collapsed configuration wherein the end panels 120 are folded over the side panels 140. For example, the lock tabs 154 are inset from the fold lines FE and thereby protected from being bent or crushed by folding of the outer panels 122.

The holes 148 located near the centers of the side panels 140 can serve to make it easier and more intuitive for the product user to unlock the folded box so that it can be collapsed back into the collapsed configuration for storage and later reuse.

Figure 10:
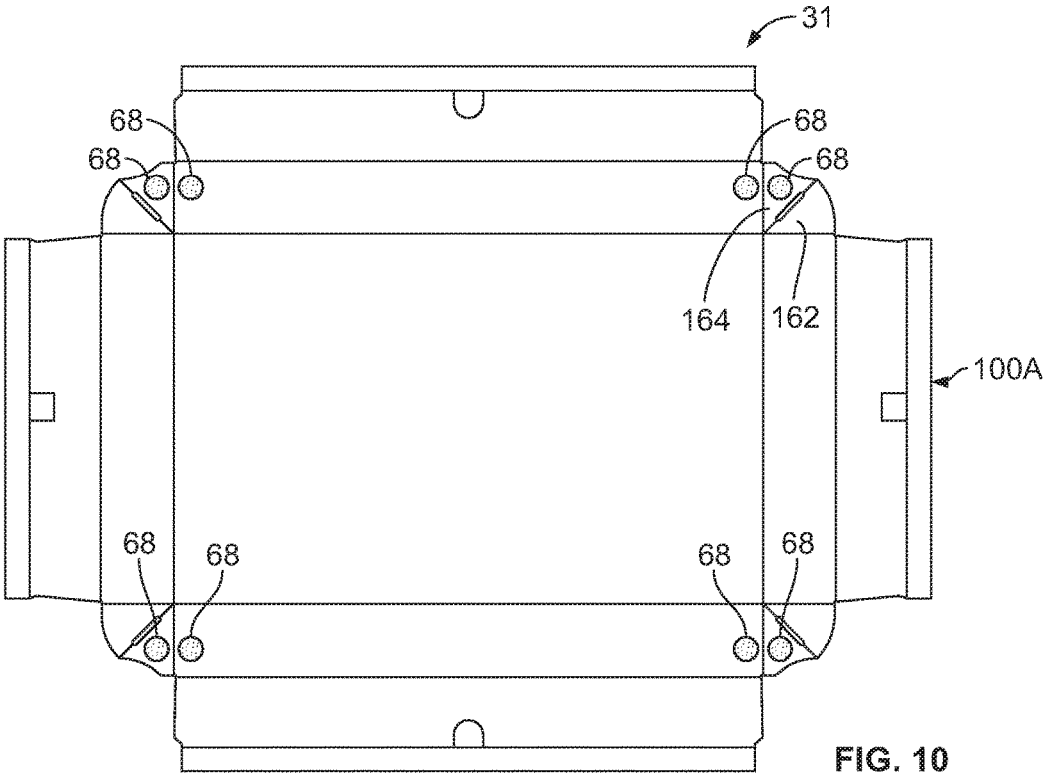
FIG. 10 is a top plan view of the multi-ply unit of FIG. 5 modified to further include corner adhesive patches.

With reference to FIG. 10, the multi-ply unit 31 may be further provided with adhesive layers, strips or patches 68 selectively applied to the inside surface of the blank 100A (i.e., the surface opposite the outer layer 40A). The adhesive patches 68 are located between the opposing faces of the side corner panels 164 and the adjacent outer side panel 142. FIG. 10 indicates the locations on each panel where the adhesive patches will attach. However, the adhesive patches 68 may initially be applied to only one of each set of opposing surfaces. Each side corner panel 164 and adjacent outer side panel 142 are directly adhered or bonded together when the multi-ply unit 31 is folded into the collapsed configuration.

This pre-attached or pre-bonded joint provides a significant advantage when the box is folded by the user from the collapsed configuration into the final box configuration because it keeps the corner panels 162, 164 in the correct location against the side outer panels 122 so that the product user does not have to control their location, further reducing the level of skill and experience needed to assemble the box.

In other embodiments, the adhesive is applied between the end corner panels 162 and the outer end panels 122.

Figure 11:
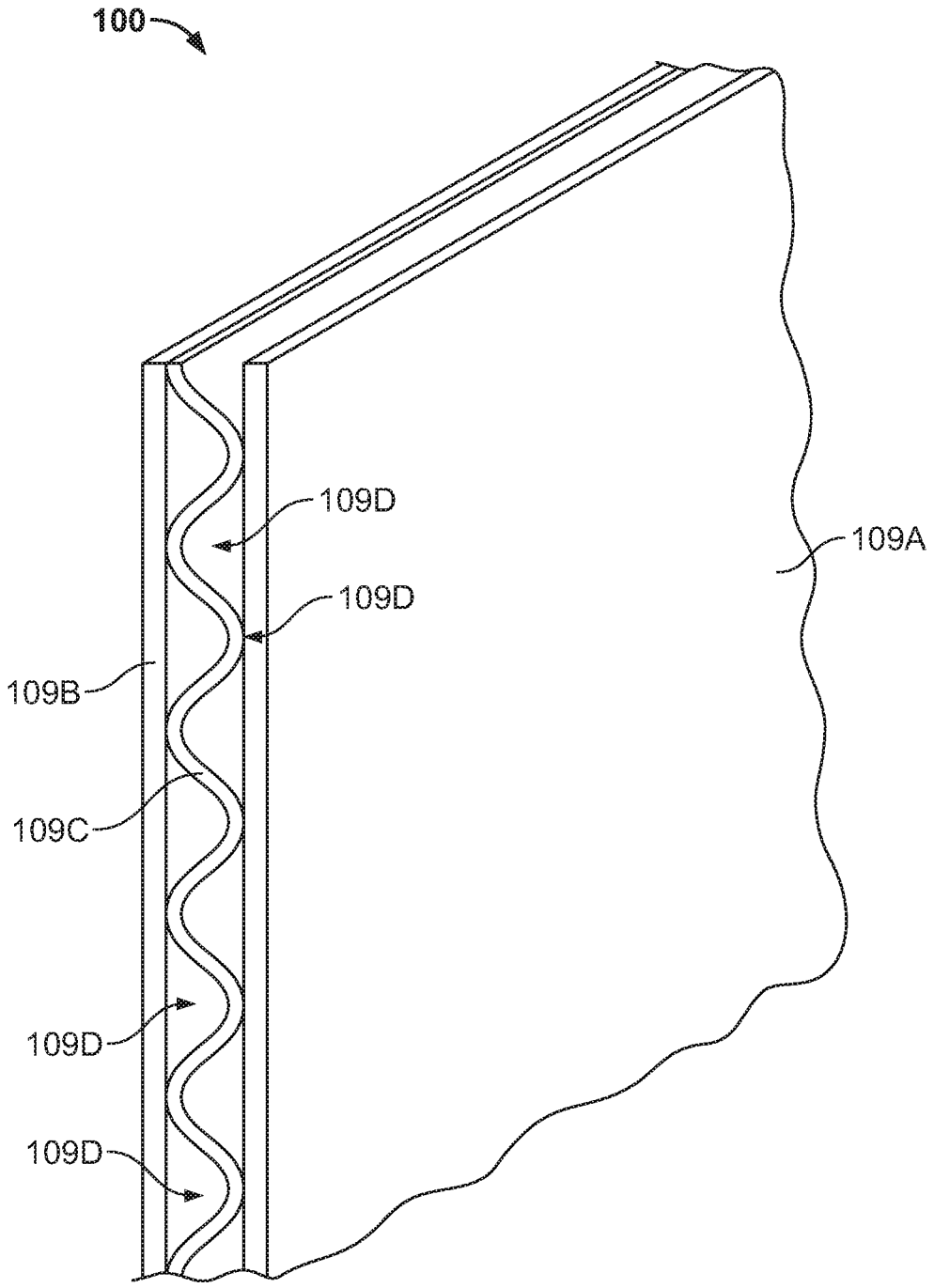
FIG. 11 is a fragmentary, perspective view of a substrate layer according to embodiments of the invention formed of corrugated fiberboard.

In some embodiments, the substrate layer 100 is formed of corrugated fiberboard. A section of an exemplary corrugated fiberboard substrate layer 100 is shown in FIG. 11. The corrugated fiberboard substrate layer 100 includes an inner liner board or sheet 109A, an outer liner board or sheet 109B, and a fluted corrugated sheet 109C interposed or sandwiched between the liner sheets 109A, 109B. The liner sheets 109A, 109B are adhered to the corrugated sheet 109C on either side such that the flutes 109D of the corrugated sheet 109C and the spacing between the liner sheets 109A, 109B is maintained. The sheets 109A-C may be formed of kraft paperboard, for example. In some embodiments, the corrugated fiberboard substrate layer 100 is E Flute corrugated fiberboard. In some embodiments, the corrugated fiberboard substrate layer 100 is C Flute corrugated fiberboard.

Box assemblies as disclosed herein can be pre-wrapped gift boxes, and cartons, multi-ply units, and blanks as disclosed herein can be used to conveniently and cost-effectively construct such pre-wrapped gift boxes. Embodiments of the invention allow a person to assemble a wrapped package that has the appearance of a traditional gift-wrapped package, but requires less skill and time to assemble. The gift box can be assembled by the consumer or at the point of sale rather than needing to be pre-assembled at the factory. This feature permits the inventive boxes to be shipped and stored in a collapsed configuration or condition, which results in a much higher packaging density during box transport and storage at the retailer location. Another advantage of the box is that after usage by the consumer the pre-wrapped gift box can be collapsed back into the original shipping and storage configuration, allowing it to be reused in the future and thereby reducing the waste associated with traditional gift wrapping.

The corners of the box are designed to interlock after final assembly by the product user. As a result, the box is easy and intuitive to assemble. The box provides tactile and/or audible feedback (e.g., a "snap") when a corner is correctly interlocked. The box can have an attractive appearance at the outside of the assembled corners. The box can be unfolded without damage so that the box can be reused in the future.

While the box assembly 10, multi-ply units 31, and cartons 20, 30 are shown and described herein as including a substrate layer (e.g., substrate layer 100) and a loose-wrapped or spot bonded decorative outer layer (e.g., layer 40), inventive aspects of the interlock mechanism and other features disclosed herein may be used with a semi-rigid layer (e.g., paperboard) that is plain, foil-stamped or printed without a separate cover layer or which includes an outer layer fully laminated to the semi-rigid layer. Likewise, inventive aspects herein relating to the mounting of the outer decorative layer on the substrate layer may be employed with multi-ply units and cartons having interlock mechanisms or structural designs other than those described herein.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A reusable blank for forming a carton, the blank comprising:

a unitary substrate layer defining a primary axis and a secondary axis transverse to the primary axis, the substrate layer including:

a main panel having a side edge extending substantially parallel to the primary axis and an end edge substantially parallel to the secondary axis;

an end outer panel connected to the end edge by a first fold line extending substantially parallel to the secondary axis;

an end inner panel connected to the end outer panel by a second fold line extending substantially parallel to the secondary axis;

a side outer panel connected to the side edge by a third fold line extending substantially parallel to the primary axis;

a side inner panel connected to the side outer panel by a fourth fold line extending substantially parallel to the primary axis;

a notch defined in a side edge of the end inner panel; and an integral tab extending from an end edge of the side inner panel adjacent the side edge of the end inner panel;

wherein the blank is configured to be erected into a carton by:

folding the end outer panel relative to the main panel about the first fold line;

folding the end inner panel relative to the end outer panel about the second fold line so that the end inner panel substantially faces the end outer panel and is deflectably spaced away from the end outer panel;

folding the side outer panel relative to the main panel about the third fold line, whereby a pocket is defined between the notch, the side outer panel, and the end outer panel;

following the steps of folding the end inner panel relative to the end outer panel and folding the side outer panel relative to the main panel, folding the side inner panel relative to the side outer panel about the fourth fold line so that the side inner panel substantially faces the side outer panel and the tab is thereby inserted through the notch and into the pocket to interlock the side inner panel and the end inner panel;

wherein the step of folding the side inner panel relative to the side outer panel elastically deflects the end inner panel toward the end outer panel to permit the tab to pass over the end inner panel as the side inner panel is folded toward the side outer panel, and releases the end inner panel to spring away from the end outer panel after the tab has entered the notch;

wherein when the carton is erected, the end inner panel is spaced apart from the end outer panel to provide a gap between the end inner panel and the end outer panel and a corresponding depth to the pocket, and the tab extends inwardly toward the end outer panel beyond the notch and into the depth; and wherein the blank is configured such that, when the carton is erected, the tab can be released from the pocket by deflecting the end inner panel toward the end outer panel, thereby permitting the carton to be collapsed.

2. The blank of claim 1 wherein the blank provides tactile and/or audible feedback when the end inner panel springs away from the end outer panel after the tab has entered the notch.

3. The blank of claim 1 wherein, when the carton is erected, the end inner panel and the side inner panel each exert a spring force on the other.

4. The blank of claim 1 wherein:

the blank further includes an end foot panel connected to the end inner panel along a fifth fold line;

the blank further includes a side foot panel connected to the side inner panel along a sixth fold line; and when the carton is erected, the side foot panel overlaps the end foot panel to capture the end foot panel between the side foot panel and the main panel and thereby inhibit the end inner panel from pivoting away from the end outer panel.

5. The blank of claim 1 further including an outer decorative sheet bonded to an outer surface of the substrate layer and covering at least a portion of each of the main panel, the end outer panel and the side outer panel.

6. The blank of claim 5 wherein the outer decorative sheet is loose wrap bonded to the substrate layer.

7. The blank of claim 5 wherein:

the substrate layer includes a corner web connecting a side edge of the end outer panel to an end edge of the side outer panel;

the outer decorative sheet includes a corner section extending beyond the end outer panel and the side outer panel and outwardly beyond the corner web; and the corner section has a cross edge defining an oblique angle with each of the primary axis and the secondary axis.

8. The blank of claim 1 wherein at least some of the first, second, third, and fourth fold lines are of a first type and at least some of the first, second, third, and fourth fold lines are of a second type, wherein the fold lines of the first type exert a greater return spring force when folded than do the fold lines of the second type when folded.

9. The blank of claim 8 wherein the fold lines of the first type are creases in the substrate layer and the fold lines of the second type are lines of perforations in the substrate layer.

10. The blank of claim 1 wherein:

the substrate layer includes:

a first corner panel connected to the end outer panel by a first corner fold line; and a second corner panel connected to the side outer panel by a second corner fold line and to the first corner panel by a third corner fold line; and the first corner panel is adhered to the end outer panel or the second corner panel is adhered to the side outer panel.

11. The blank of claim 1 wherein the end inner panel is not adhered to the end outer panel.

12. The blank of claim 1 wherein the blank is configured to be re-assembled into a second erected carton, after the carton has been disassembled by deflecting the end inner panel toward the end outer panel, by:

again folding the side inner panel relative to the side outer panel about the fourth fold line so that the side inner panel substantially faces the side outer panel and the tab is thereby inserted through the notch and into the pocket to interlock the side inner panel and the end inner panel;

wherein the step of folding the side inner panel relative to the side outer panel again elastically deflects the end inner panel toward the end outer panel to permit the tab to pass over the end inner panel as the side inner panel is folded toward the side outer panel, and releases the end inner panel to spring away from the end outer panel after the tab has entered the notch; and wherein when the second carton is erected, the end inner panel is again spaced apart from the end outer panel to provide a gap between the end inner panel and the end outer panel and a corresponding depth to the pocket, and the tab extends inwardly toward the end outer panel beyond the notch and into the depth.

13. The blank of claim 1 wherein:

the end inner panel includes a second side edge opposite the side edge; and the gap between the end inner panel and the end outer panel extends throughout an entire length from the side edge to the second side edge.

14. A method for using a blank and forming a carton, the method comprising:

providing a reusable blank including a unitary substrate layer, the blank defining a primary axis and a secondary axis transverse to the primary axis, the substrate layer including:

a main panel having a side edge extending substantially parallel to the primary axis and an end edge substantially parallel to the secondary axis;

an end outer panel connected to the end edge by a first fold line extending substantially parallel to the secondary axis;

an end inner panel connected to the end outer panel by a second fold line extending substantially parallel to the secondary axis;

a side outer panel connected to the side edge by a third fold line extending substantially parallel to the primary axis;

a side inner panel connected to the side outer panel by a fourth fold line extending substantially parallel to the primary axis;

a notch defined in a side edge of the end inner panel; and an integral tab extending from an end edge of the side inner panel adjacent the side edge of the end inner panel; and forming a carton from the blank, including:

folding the end outer panel relative to the main panel about the first fold line;

folding the end inner panel relative to the end outer panel about the second fold line so that the end inner panel substantially faces the end outer panel and is deflectably spaced away from the end outer panel;

folding the side outer panel relative to the main panel about the third fold line, whereby a pocket is defined between the notch, the side outer panel, and the end outer panel; thereafter following the steps of folding the end inner panel relative to the end outer panel and folding the side outer panel relative to the main panel, folding the side inner panel relative to the side outer panel about the fourth fold line so that the side inner panel substantially faces the side outer panel and the tab is thereby inserted through the notch and into the pocket to interlock the side inner panel and the end inner panel;

wherein the step of folding the side inner panel relative to the side outer panel elastically deflects the end inner panel toward the end outer panel to permit the tab to pass over the end inner panel as the side inner panel is folded toward the side outer panel, and releases the end inner panel to spring away from the end outer panel after the tab has entered the notch;

wherein when the carton is erected, the end inner panel is spaced apart from the end outer panel to provide a gap between the end inner panel and the end outer panel and a corresponding depth to the pocket, and the tab extends inwardly toward the end outer panel beyond the notch and into the depth; and wherein the blank is configured such that, when the carton is erected, the tab can be released from the pocket by deflecting the end inner panel toward the end outer panel, thereby permitting the carton to be collapsed.

15. The method of claim 14 wherein the blank provides tactile and/or audible feedback when the end inner panel springs away from the end outer panel after the tab has entered the notch.

16. The method of claim 14 including:

with the carton erected, deflecting the end inner panel toward the end outer panel to thereby release the tab from the pocket; and collapsing the carton.

17. The method of claim 16 further including, following the step of disassembling the carton, re-assembling the blank into a second erected carton, after the carton has been disassembled by deflecting the end inner panel toward the end outer panel, by:

again folding the side inner panel relative to the side outer panel about the fourth fold line so that the side inner panel substantially faces the side outer panel and the tab is thereby inserted through the notch and into the pocket to interlock the side inner panel and the end inner panel;

wherein the step of folding the side inner panel relative to the side outer panel again elastically deflects the end inner panel toward the end outer panel to permit the tab to pass over the end inner panel as the side inner panel is folded toward the side outer panel, and releases the end inner panel to spring away from the end outer panel after the tab has entered the notch;

wherein when the carton is re-assembled, the end inner panel is again spaced apart from the end outer panel to provide a gap between the end inner panel and the end outer panel and a corresponding depth to the pocket, and the tab extends inwardly toward the end outer panel beyond the notch and into the depth.

18. The method of claim 14 wherein, when the carton is erected, the end inner panel and the side inner panel each exert a spring force on the other.

19. The method of claim 14 wherein:

the blank further includes an end foot panel connected to the end inner panel along a fifth fold line;

the blank further includes a side foot panel connected to the side inner panel along a sixth fold line; and when the carton is erected, the side foot panel overlaps the end foot panel to capture the end foot panel between the side foot panel and the main panel and thereby inhibit the end inner panel from pivoting away from the end outer panel.

20. The method of claim 14 further including bonding an outer decorative sheet to an outer surface of the substrate layer such that the outer decorative sheet covers at least a portion of each of the main panel, the end outer panel and the side outer panel.

21. The method of claim 20 wherein bonding the outer decorative sheet to the outer surface of the substrate layer includes loose wrap bonding the outer decorative sheet to the substrate layer.

22. The method of claim 21 wherein bonding the outer decorative sheet to the outer surface of the substrate layer includes:

adhering the outer decorative sheet to the outer surface of the substrate layer with a flowable adhesive while the substrate layer is in a first position; thereafter bending the substrate layer into a second position such that the outer decorative sheet and the outer surface of the substrate layer slide relative to one another; thereafter setting the adhesive while the substrate is in the second position to thereby permanently affix the outer decorative sheet to the outer surface of the substrate layer with the set adhesive; and thereafter bending the substrate layer into a third position.

23. The method of claim 20 wherein, when the outer decorative sheet is bonded to the substrate layer:

the substrate layer includes a corner web connecting a side edge of the outer end outer panel to an end edge of the side outer panel;

the outer decorative sheet includes a corner section extending beyond the end outer panel and the side outer panel and outwardly beyond the corner web; and the corner section has a cross edge defining an oblique angle with each of the primary axis and the secondary axis.

24. The method of claim 14 wherein at least some of the first, second, third, and fourth fold lines are of a first type and at least some of the first, second, third, and fourth fold lines are of a second type, wherein the fold lines of the first type exert a greater return spring force when folded than do the fold lines of the second type when folded.

25. The method of claim 14 wherein:

the substrate layer includes:

a first corner panel connected to the end outer panel by a first corner fold line; and a second corner panel connected to the side outer panel by a second corner fold line and to the first corner panel by a third corner fold line; and the method includes adhering the first corner panel to the end outer panel or adhering the second corner panel to the side outer panel.

26. The method of claim 14 wherein the end inner panel is not adhered to the end outer panel.

27. The method of claim 14 wherein:

the end inner panel includes a second side edge opposite the side edge; and the gap between the end inner panel and the end outer panel extends throughout an entire length from the side edge to the second side edge.

* * * * *